United States Patent [19]

Mawer et al.

[11] Patent Number: 4,969,502

[45] Date of Patent: Nov. 13, 1990

[54] METHOD AND APPARATUS FOR THE CASTING OF METALS

[75] Inventors: Eric L. Mawer; Martin Vanderminnen, both of Fruitvale; Robert D. H. Willans, Trail, all of Canada

[73] Assignee: Cominco Ltd., Vancouver, Canada

[21] Appl. No.: 350,290

[22] Filed: May 11, 1989

[51] Int. Cl.[5] ..... B22D 39/00

[52] U.S. Cl. ..... 164/135; 164/133; 164/136; 164/335

[58] Field of Search ..... 164/133, 135, 136, 335, 164/336, 125, 126, 128, 130, 324, 325, 326; 222/590, 604, 605

[56] References Cited

U.S. PATENT DOCUMENTS

| | | | |
|---|---|---|---|
| 1,755,411 | 4/1930 | Peirce | 164/335 |
| 1,850,477 | 3/1932 | Roth | 164/125 |
| 3,863,703 | 2/1975 | Nishimura | 164/130 |
| 4,050,961 | 9/1977 | Knight | 164/128 |
| 4,267,877 | 5/1981 | Leiponen | 164/130 |
| 4,741,377 | 5/1988 | Roberti et al. | 164/130 |

FOREIGN PATENT DOCUMENTS

| | | | |
|---|---|---|---|
| 54-101720 | 8/1979 | Japan | 164/335 |

*Primary Examiner*—Richard K. Seidel
*Attorney, Agent, or Firm*—Arne I. Fors

[57] ABSTRACT

Molten metals or alloys are poured into a stationary plate mold from at least one elongated pouring device such that melt overflows the length of the mold. The pouring energy is dissipated by flowing the elongated flow from one stationary device against an energy dissipating plate adjacent the pouring device in proximity to either one of the mold center lines such that the flow forms two balanced streams on the bottom of the mold. Alternatively, an elongated flow is poured from each of two stationary pouring devices positioned in opposing directions along the opposite sidewalls of the mold. Alternatively, the two pouring devices may move from one of the mold center lines towards the sidewalls while pouring molten metal. The pouring energy is dissipated by flowing two of the balanced streams formed on the bottom of the mold towards each other. The dissipation of pouring energy results in the substantial elimination of wave action and flash whereby castings with an even thickness are produced. Apparatus for carrying out the method is described. The plate mold preferably has a layer of flexible insulating material, that may be at least partly molded, attached to its substantially vertical sidewall.

10 Claims, 4 Drawing Sheets

METHOD AND APPARATUS FOR THE CASTING OF METALS

This invention relates to a method and apparatus for the casting of metals and, more particularly, to a method and apparatus for making castings with an even thickness.

BACKGROUND OF THE INVENTION

In the casting of metals in plate molds it is often a requirement that the resulting castings have an even thickness. In many cases, however, variations in thickness occur as a result of the method of casting.

When molten metal is cast in horizontal plate molds into sheets, plates or slabs variations in thickness of the casting occur because of wave action in the molten metal. The wave action is a result of the pouring of molten metal into the mold and the freezing of the molten metal. If a crest of a wave impinges on the mold wall at the moment that the metal is ready to solidify, the metal freezes to the thickness of the wave crest, whereas at another time it may be a valley in the wave that freezes. This wave phenomenon, therefore, causes the thickness of the plate casting to vary.

Uneven thickness of plate castings is also caused by the formation of a flash of metal at the edge of the casting. Waves that are created in the main body of the casting hit the side wall and climb up onto it. Because the side wall is usually at a lower temperature the skin of the wave crest in contact with the mold freezes, while the remaining of the wave drops back. This results in thin projections (flash) along the edges of the casting.

Uneven thickness of a plate casting is a particular problem with electrodes that are used in metal electrodeposition processes.

Electrodes having integral lifting lugs for metal electro-deposition processes are traditionally cast in apparatus that includes a number of molds placed at the perimeter of a casting wheel. Variations in thickness in the lifting lugs of the electrodes, caused by the wave phenomenon, make it unsafe and difficult to pick up a number of electrodes by one lifter having a number of grabs that have to fit between the electrodes and then twist to hook under the lugs. Because of thickness variations, an operator can not manipulate the grabs over the electrodes to ensure that every electrode in the group is securely held in the grabs before lifting. A tolerance has to be designed into the grabs which will mean that invariably certain electrodes will fall off the grabs or prevent the grabs from moving under the lugs.

The occurrence of a flash of metal at the edges of the electrodes is a source of electrical shorts during electrodeposition that must be accommodated in the cells by providing sufficient, i.e. increased, spacing between electrodes.

Although book molds can be used for making copper bullion electrodes for use in a copper refinery, book molds are not suitable for casting electrodes of lead bullion for use in the electrorefining of lead by the Betts or the bipolar process. The use of bookmolds for lead bullion causes variations in crystal structure in the electrodes that are not inducive into retaining slime on the electrode, and slime falls into the electrolyte to the detriment of the electrolytic process.

Book molds are also unsuitable for casting the thin anodes used in the electrowinning of zinc. The anodes are usually made of a lead-silver-calcium alloys. The presence of air during casting in a book mold causes oxidation and entrapment. The entrapped air causes porosity in which the oxygen is consumed by the calcium forming a vacuum. When the oxygen is consumed while the electrode is residing in the cell, the vacuum will draw electrolyte into the cavity through micro cracks in the metal. The electrolyte then attacks the oxides along the grain boundaries resulting in very rapid and severe corrosion.

DESCRIPTION OF THE PRIOR ART

The use of casting wheels and book molds for casting electrodes for metal electro-deposition processes, especially lead and copper electro-refining processes, has been disclosed.

According to U.S. Pat. No. 974 541 there is disclosed a casting wheel for anodes, the moving molds are cooled from below with water sprays. According to CA Patent No. 1 019 132 large lead anodes are cast with a casting wheel with the pouring temperature controlled at 340–350° C. The flow velocity of the melt is reduced without decreasing its volume by pouring melt through screens. Cooling is sequentially applied to the melt surface and to the mold bottom. 400 Kg anodes are poured in 12 to 14 seconds and cooling is started 30 seconds after a lapse of 2 to 3 minutes after pouring. According to U.S. Pat. Nos. 3 981 353, 4 050 961 and 4 124 482 lead alloy anodes are cast in a book mold using a tipping pouring device that provides a number of melt streams along the length of the top of the mold. It is disclosed that coarse grain size should be maintained, the melt temperature controlled, the solidification time minimized, the flow of the melt in the mold minimized (the pouring time is 20 to 30 seconds) and that the casting remains in the mold 1 to 2 minutes after pouring is completed.

Other prior art relevant to the present invention relates to the casting of molten metal into molds from more than one pouring spout or nozzle, such as disclosed in U.S. Pat. Nos. 2 049 148, 2 151 683, 2 779 073, 3 456 713, 3 583 470 and 4 509 578, and to the use of an insulating material at the edge of the mold, such as disclosed in U.S. Pat. Nos. 3 326 270 and 3 726 332.

These prior art disclosures do not provide any teaching on how to eliminate variations in thickness of a relatively thin casting such as an electrode and the formation of flash at the castings edge.

SUMMARY OF THE INVENTION

We have now found that variations in the thickness of castings and the formation of flash can be substantially eliminated by casting in a mold that is kept stationary during pouring, and by using a method of pouring molten metal that dampens out waves of molten metal in the mold. More specifically, by pouring molten metal into a stationary plate mold such that the energy inherent in the pouring is substantially dissipated, any wave action is essentially eliminated and the casting has a substantially even thickness. Moreover, any wave action is prevented from being amplified and especially in extensions of the casting such as, for example, the lifting lugs of electrodes. The dissipation of pouring energy and the elimination of wave action may be achieved in a number of ways.

Generally, an amount of molten metal is poured into a rectangular plate mold from at least one pouring device to form two elongated streams from each device on the bottom of the mould of substantially equal volume substantially parallel to a mold centre line in opposite directions. The amount of metal is sufficient to form a casting of predetermined thickness. The pouring energy is dissipated during pouring, the metal is solidified, and the casting, having an even thickness, is removed from the mold.

According to one specific embodiment, molten metal is poured from one elongated pouring device substantially along the full length or the full width of the mold. The word metal as used hereinafter is to be understood as being inclusive of alloys. The pouring device is positioned parallel to the longitudinal centre line or the transverse centre line of the mold and a short distance above the bottom of the mold. The melt pouring from the pouring device is caused to hit an energy dissipating plate positioned parallel to and substantially along the length of the device in proximity to the longitudinal centre line or the transverse centre line of the mold. The molten metal flowing from the device hits the energy dissipating plate, and flows with little turbulence into and over the mold bottom towards the sides of the mold in two streams that are balanced to yield a casting with even thickness. The formation of waves is substantially obviated.

According to a second specific embodiment, melt is poured from two identical elongated pouring devices located in opposing positions parallel to and just above the longitudinal or the transverse portions of the sidewall of the mold. When molten metal is poured simultaneously from the two devices by tipping them, the molten metal flows in opposite directions towards and away from each other. The flows flowing towards each other impact on the bottom of the mould. The flows impact in the middle of the mold at the longitudinal or the transverse centre line to dissipate the dynamic energy, so that any waves are substantially dampened out. The dampening out is enhanced by the fact that the mold is stationary.

According to a third specific embodiment, the two pouring devices of the second specific embodiment may be movable over a portion of the distance between one of the centre lines and corresponding sidewall portions of the mold, the movement describing a shallow arc. The molten metal is simultaneously poured from the devices into the mould to form flows of molten metal comprising two streams on the bottom of the mould in opposite direction towards each other when the devices travel away from each other, the pouring being carried out at an even rate starting in proximity of the longitudinal or the transverse centre line and being completed when the pouring edge of the devices is in proximity of the longitudinal or the transverse portions of the sidewall of the mold. The moving of the pouring devices during pouring avoids the formation of hot spots on the mold bottom due to pouring in one location and also results in a more even temperature of the bottom of the mold.

In all embodiments the formation of flash may be prevented by a layer of flexible insulating material applied all along the vertical sidewall of the mold. This layer acts as an insulator, and a skin of metal is not immediately frozen when molten metal impinges on the sidewall of the mold, thereby allowing the melt surface to level out and eliminating the formation of flash. The layer of insulating material may be shaped at three of the sidewall portions of the mold to provide the electrode with rounded edges.

The rectangular plate mold is generally made of steel and may have a water-cooled bottom. The sidewall may be made continuous or in sections that may be fixedly or removably attached to the mold bottom. The casting may also be cooled from above. The cooling of the bottom is preferably controlled to ensure that solidification occurs at a rate to yield the desired crystal structure of the casting.

The method and apparatus according to the invention are particularly useful for casting electrodes used in processes for the electro-deposition of metals.

It is an object of the present invention to provide a casting method for producing castings that have a substantially even thickness and essentially no flash.

It is another object to provide a method for the casting of electrodes used in electro-deposition processes for metals.

It is still another object to provide an apparatus for the casting of metal plates that have a substantially even thickness and essentially no flash.

According to the broadest aspect of the invention there is provided a method for producing a casting in a substantially horizontal, substantially rectangular plate mold, said mold having a flat substantially horizontal bottom, said substantially vertical side wall attached to said bottom, said substantially vertical sidewall comprising a pair of parallel longitudinal sidewall portions and a pair of parallel transverse sidewall portions, the length of said longitudinal sidewall portions being at least equal to the length of said transverse sidewall portions, said mold having centre lines comprising a longitudinal centre line parallel to said longitudinal sidewall portions and a transverse centre line parallel to said transverse sidewall portions, said method comprising the steps of pouring an amount of molten metal into said mold from at least one pouring device to form two elongated streams from each device on the bottom of the mould, said streams being of substantially equal volume substantially parallel to one of said centre lines in opposite directions, said amount of molten metal being sufficient to form a casting of predetermined thickness in said mold; dissipating the pouring energy of the molten metal while said amount of molten metal is being poured; solidifying said molten metal to form said casting; and removing said casting from said mold, said casting having a substantially even thickness throughout.

Preferably, the molten metal is poured from one pouring device into the mold in proximity to and substantially along the length of one of the centre lines and said pouring energy is dissipated during said pouring by means of a pouring energy dissipating plate, said plate being operatively connected to said pouring device, and said plate being vertical, parallel to and in proximity to said pouring device substantially along and in proximity to said centre line during pouring of the molten metal.

Preferably, two elongated flows are poured substantially simultaneously from two pouring devices opposedly positioned substantially parallel to and substantially along the full length of each of the sidewalls of one of the pairs of the pair of longitudinal sidewall portions and the pair of transverse sidewall portions in a direction towards the centre line of the corresponding sidewall portions.

Preferably, the pouring of the amount of molten metal being poured simultaneously from said two pouring devices is carried out in proximity to each sidewall portion of one of the pairs of said pair of longitudinal sidewall portions and said pair of transverse sidewall portions.

Preferably, the pouring of the amount of molten metal being poured simultaneously from said two pouring devices is started in proximity of said centre line and is completed in proximity of each sidewall portion of the corresponding pair of parallel sidewall portions.

Preferably, the sidewall has a layer of flexible insulating material applied thereto along its full length whereby the casting is essentially free of flash.

In its broad aspect, there is also provided an apparatus for the casting of metal plates which comprises a substantially rectangular plate mold according to the broadest aspect of the method; at least one rotatable-elongated pouring device positioned above the bottom of said mold, said pouring device being adapted to hold a charge of molten metal, said pouring device having an overflow edge, said overflow edge being substantially parallel to one of the longitudinal centre line and the transverse centre line and having a length that is substantially equal to the length of one of the longitudinal centre line between said longitudinal sidewall portions and the transverse centre line between said transverse sidewall portions; means to rotate said at least one pouring device such that said charge flows from each said device into said mold over the full length of said overflow edge; and means for dissipating the pouring energy from the flowing of said charge into said mold such that said charge flows in said mold in two elongated streams from each of said pouring devices, said streams being of substantially equal volume parallel to one of said centre lines in opposite directions to each other to provide a casting having a substantially even thickness.

Preferably, one rotatable elongated pouring device is positioned above the bottom of said mold and said means for dissipating the pouring energy comprises a pouring energy dissipating plate operatively connected vertically in proximity and parallel to said device and in proximity to one of said centre lines during pouring of said charge into the mold.

Preferably, two rotatable elongated pouring devices are positioned above the bottom of said mold each in proximity to one pair of said pair of longitudinal sidewall portions and said pair of transverse sidewall portions and in opposing directions such that the overflow edges are in a direction parallel to and towards one of said centre lines.

Preferably, means are provided to move said two rotatable pouring devices during discharging of molten metal therefrom from the proximity of one of said centre lines to the proximity of each of the sidewalls of one pair of the pair of longitudinal sidewall portions and the pair of transverse sidewall portions.

Preferably, a layer of flexible insulating materials is attached to said sidewall along its full length and height; at least a portion of said layer of flexible insulating material may be adapted to form a casting having rounded edges.

BRIEF DESCRIPTION OF THE DRAWINGS

The objects of the invention and the manner in which they will be attained will become clear from the following detailed description of the drawings, wherein.

DETAILED DESCRIPTION OF THE INVENTION

Figure 1:
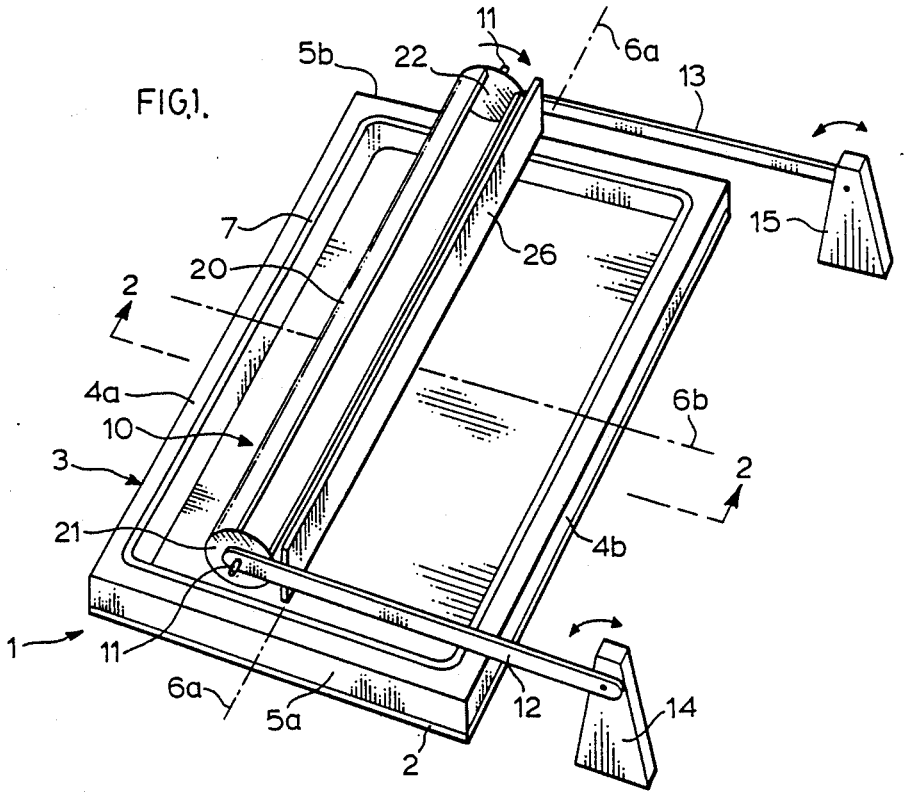
FIG. 1 is a schematic isometric view of the first embodiment of the invention.

With reference to FIG. 1, the mold, generally indicated at 1, is a plate mold suitable for casting plates, sheets or slabs of a metal from a melt. The mold 1 has a generally square or rectangular shape and is usually positioned in a generally horizontal position. The mold may also be positioned under a slight angle to the horizontal along its longitudinal centre line *6a* (to be described) such that a casting produced in the mold has a slightly tapered longitudinal cross section. The mold 1 may have the shape of an anode 100 (shown in FIG. 3) such as used in electrodeposition processes for metals such as, for example, the electrorefining of copper or lead. In those processes the electrodes may have two ears or lifting lugs 103, a lower edge 101, an upper edge 102 and two side edges 104. Lugs 103 are attached to and integral with upper edge 102 of the electrode. The lifting lugs serve to support the electrode when suspended in an electrolytic cell. In another form of an electrode 110 (shown in FIG. 4), such as for example may be used in the electrowinning of zinc, lower edge 112 of the electrode may have one or more indentations or slots 111 (three shown in FIG. 4) adapted for the attachment of electrode spacer clips (not shown). A header bar 113 for supporting electrode 110 in an electrolytic cell is usually attached to the top edge 114 after the electrode has been removed from the mold. The side edges 104 and 115 and the lower edges 101 and 112 are preferably rounded, while the corners between side and lower edges are curved.

Figure 5:
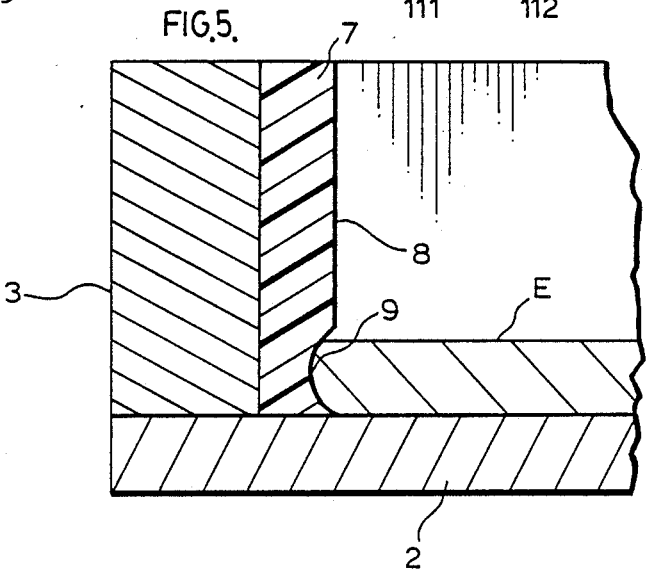
FIG. 5 is a cross section through the mold wall and layer of insulating material.

Mold 1 has a flat substantially horizontal bottom 2 and a substantially vertical sidewall 3 fixedly or suitably removably attached to bottom 2. Sidewall 3 may be vertical or inclined at a small angle from the vertical in a direction outward towards the top of the sidewall. The sidewall 3 may be made continuous. Alternatively, sidewall 3 may be made in one or more sections. Sidewall 3 comprises a pair of generally parallel longitudinal sidewall portions *4a* and *4b* and a pair of generally parallel transverse vertical sidewall portions *5a* and *5b*. One of portions *5a* and *5b* may have integral extensions to provide for lifting lugs 103 or protrusions (not shown) to provide for slots 111. The sidewall portions connect in the corners of the mold. The inside corners of the mold are, preferably, curved, and the bottom and side edges are slightly rounded. The length of the longitudinal sidewall portions *4a* and *4b* is at least equal to the length of the transverse sidewall portions *5a* and *5b*, the longitudinal sidewall portions usually being longer than the transverse sidewall portions. Mold 1 has centre lines 6, i.e. a longitudinal centre line *6a* and a transverse centre line *6b*, generally parallel to the corresponding sidewall portions *4a* and *4b*, and *5a* and *5b*, respectively. Preferably, the substantially vertical sidewall 3, or the sections thereof, has a lining layer 7 made of a flexible insulating material attached thereto. This lining 7 acts as an insulator during pouring of molten metal into the mold. When molten metal impinges on sidewall 3, molten metal is not immediately frozen, and levels out before freezing without the formation of flash. Lining 7 extends along the full length and height of sidewall 3 and includes any extensions or protrusions of the mold wall. Lining 7 is made of a material that is suitable to withstand the temperatures of the molten metal. For example, in castings made of lead bullion or lead alloy, the mold has a lining made of rubber or silicon rubber attached to wall 3 with a suitable adhesive. If desired, the portions of lining 7 along the longitudinal sidewall portions 4*a* and 4*b* and one of the transverse sidewall portions 5*a* and 5*b* may have a molded shape to provide the rounded edges 101, 104, 112 and 115 of the electrodes. The molded shape is shown in FIG. 5 wherein lining 7 is shown to have an upper vertical face portion 8 on the inside of the mold and a lower rounded face portion 9 extending from the bottom 2 of the mold. The height of the rounded face portion 9 is such that when the electrode (indicated with E) is poured, rounded face portion 9 extends above the top surface of the electrode. The curvature of the rounded portion is sufficient to provide the degree of rounding of the electrodes that is required, and the height extending above the bottom of the mold is greater than the thickness of the casting. The depth of the rounded portion is preferably such that the electrode shrinks away from the lining upon cooling, and can be vertically removed from the mold. Alternatively, the sidewall 3 with lining 7, or one or more portions thereof, may be removed from the bottom 2 of mold 1 to allow removal of the electrode.

A rotatable elongated pouring device, generally indicated at 10, is adapted to hold a charge of molten metal, and is positioned above bottom 2 parallel to and in proximity to either the longitudinal centre line 6*a* or the transverse centre line 6*b* (not shown). Pouring device 10 may have a heat-insulating lining. The longitudinal position is shown in FIGS. 1, 2, 6, 7 and 8, and descriptions are given with reference to this position only. Pouring device 10 is rotatably mounted on axes 11 suitably attached to the ends of the pouring device. Positioning means are provided to move pouring device 10 to above the bottom 2 of mold 1 and to move device 10 away from above the mold. For example, the pouring device may be supported by one end of each of support arms 12 and 13 mounted on the of axes 11, respectively. The other end of support arms 12 and 13 is attached to fulcrums 14 and 15, respectively. Pouring device 10 with axes 11 and support arms 12 and 13 can be pivoted on fulcrums 14 and 15 to position the pouring device above mold 1 and its bottom 2 or move it away from above mold 1. The rotation of arms 12 and 13 may have a limitation such that the pouring device remains suspended at mold 1 at a desired distance above the bottom of the mold. As one alternative to using fulcrums 14 and 15, support arms 12 and 13 may be operated by hydraulic means (not shown) to move pouring device 10 to above mold 1 or away therefrom.

Alternatively, the pouring device 10 is stationary and in a fixed position clearing the top of the mold, and means (not shown) may be provided so that the mold may be moved under the device or away therefrom. Moving either pouring device or mold allows for the removal of the casting from the mold.

Pouring device 10 consists of an elongated container portion 20 having end plates 21 and 22 respectively at each end, axes 11 being centrally attached to end plates 21 and 22. Elongated container portion 20 has a partial wall portion 23 which provides an opening 24 having an overflow edge 25 substantially over the full length of elongated portion 20. Molten metal may be added through opening 24 into the pouring device, and may be discharged therefrom over overflow edge 25 by rotating the pouring device on axes 11. The elongated container portion 20 may have any one of a number of suitable cross sections, such as circular (as shown), circle segment, circle sector, square, rectangular, oval, V-shaped, U-shaped, basket-shaped or the like. The length of the pouring device is substantially the same as, usually somewhat shorter than, the length of longitudinal centre line 6*a* or transverse centre line 6*b* between transverse sidewall portions 5*a* and 5*b* and longitudinal sidewall portions 4*a* and 4*b*, respectively. The volume of pouring device 10 is sufficient to contain at least the amount of molten metal necessary for the formation of a casting of the desired thickness (weight) in mold 1. If desired, pouring device 10 may have a heat-insulating lining made of a suitable material.

A pouring energy dissipating plate 26 is operatively connected to pouring device 10 between support arms 12 and 13 and parallel to pouring device 10. Dissipating plate 26 is vertically positioned in proximity to centre line 6*a* or 6*b* just above bottom 2 of mold 1 and in close proximity to pouring device 10, plate 26 being in a position between pouring device 10 and centre line 6*a* or 6*b*. Pouring device 10 is positioned at one side of plate 26 such that molten metal overflowing over overflow edge 25 of opening 24 when pouring device 10 is rotated around its axes 11 hits dissipating plate 26, and flows at least in part along its surface before flowing vertically downward onto bottom 2 of mold 1. The exact location of dissipating plate 26 (and pouring device 10) with respect to centre line 6*a* or 6*b* is dependent on the metal being cast and is predetermined such that the flow of molten metal from the pouring device, when flowing substantially vertically downward from plate 26 onto the bottom, separates into two streams of substantially equal volume and substantially parallel to the centre line. The two streams are directed to the opposite sidewall portions 4*a* and 4*b* or 5*a* and 5*b* of the mold, and are essentially balanced. The pouring energy is effectively dissipated and castings of even thickness are obtained. To effect a balance it is usually necessary to position the plate and pouring device off-centre at some distance that can be easily, visually determined.

Figure 6:
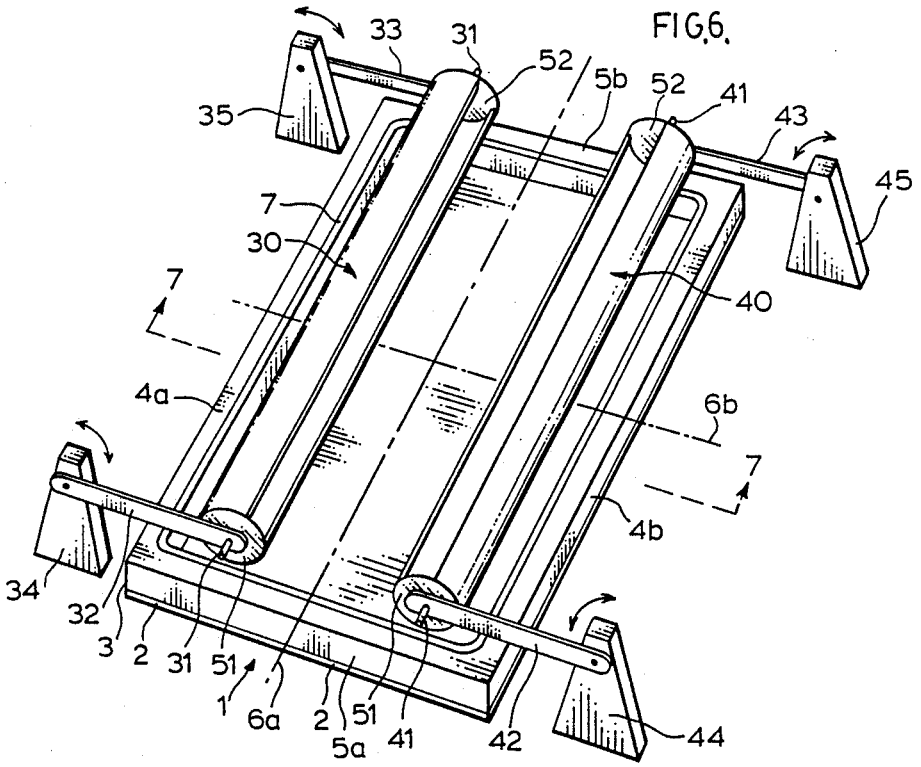
FIG. 6 is a schematic isometric view of the second embodiment of the invention.
Figure 7:
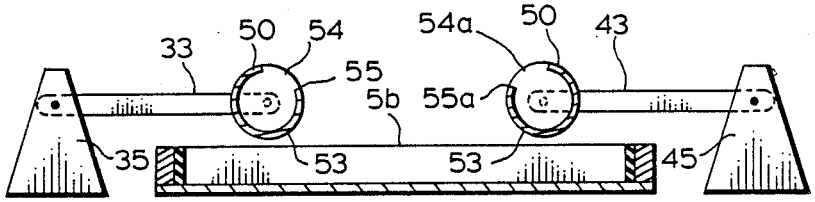
FIG. 7 is a section through line B—B of FIG. 6.

FIGS. 6 and 7 show a second embodiment of the apparatus according to the invention. The mold 1 is as described with reference to FIGS. 1 and 2 and consists of a bottom 2, a sidewall 3 comprising two parallel sidewall portions 4*a* and 4*b*, two parallel sidewall portions 5*a* and 5*b* and centre lines 6*a* and 6*b*. Sidewall 3 may be provided with a flexible insulating lining 7, as described, attached to sidewall 3 with a suitable adhesive.

Along and in proximity to each of sidewall portions 4*a* and 4*b* are positioned pouring devices 30 and 40, respectively, each being generally identical in shape to pouring device 10 or its alternative shapes. Devices 30 and 40 may have a heat-insulating lining. Pouring devices 30 and 40 are rotatably mounted on axes 31 and 41, respectively, attached to the ends of the devices and supported by positioning means to move pouring devices 30 and 40 to above and away from above bottom 2 of mold 1. For example, the pouring devices may be supported between pairs of support arms 32 and 33 and 42 and 43, the support arms being pivotable on fulcrums 34, 35 and 44, 45, respectively. Fulcrums 34 and 35 are positioned outside the mold at its sidewall portion 4*a*, and fulcrums 44 and 45 are positioned outside the other side of the mold at its sidewall portion 4*b*. The rotation of the support arms may be limited such that the pouring devices are suspended at a desired distance above the mold in a stationary position during pouring. As an alternative means for moving pouring devices 30 and 40 to above the mold and away from above the mold, the support arms may be operated by hydraulic cylinders (not shown) that move the pouring devices to or away from above the mold.

Pouring devices 30 and 40, adapted to hold a charge of molten metal, each has a suitably-shaped elongated container portion 50 closed at both ends with end plates 51 and 52 to which axes 31 and 41 are centrally attached, respectively. Elongated container portion 50 has a partial wall portion 53 which provides an opening 54 for device 30 and an opening 54*a* for device 40 substantially over the length of wall portion 53. Molten metal may be added to pouring devices 30 and 40 through openings 54 and 54*a*, respectively, and the charge in the pouring devices may be discharged therefrom through openings 54 and 54*a* over overflow edges 55 and 55*a*, respectively, by rotating devices 30 and 40 around axes 31 and 41. Pouring devices 30 and 40 are positioned in opposing directions such that their respective openings 54 and 54*a* are directed towards each other and towards one of the centre lines 6 of the mold.

Figure 8:
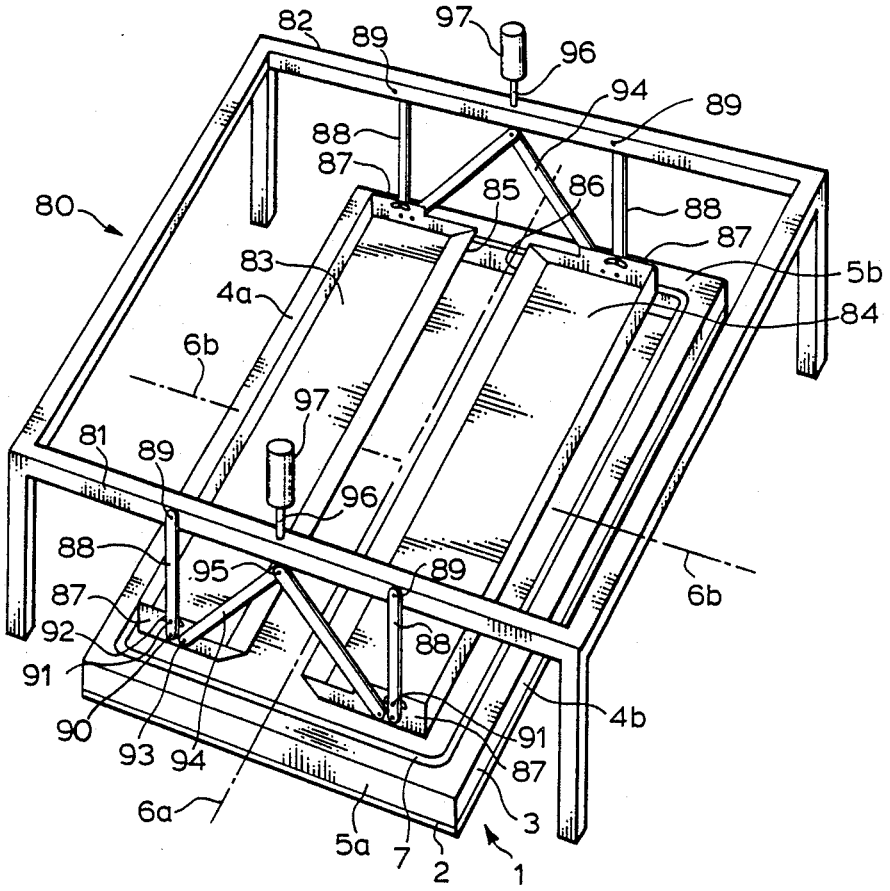
FIG. 8 is a schematic isometric view of an alternative for the second embodiment of the invention.

An alternative embodiment of the embodiment shown in FIGS. 6 and 7 is shown in FIG. 8. In this alternative embodiment the pouring devices are adapted to move during discharging of molten metal therefrom in arcuate paths that extend from the proximity of one of the centre lines 6 to the proximity of either the longitudinal or transverse sidewall portions.

With reference to FIG. 8, this embodiment includes a mold 1 having a bottom 2, a sidewall 3 and, preferably, a lining 7, sidewall portions 4*a*, 4*b*, 5*a* and 5*b*, and centre lines 6*a* and 6*b*, as described. Straddling mold 1 is a frame generally indicated at 80 that comprises two parallel cross bars 81 and 82 from which pouring devices 83 and 84 are movably suspended. Pouring devices 83 and 84 may be similar in shape to pouring devices and their alternative shapes already described. The devices 83 and 84 shown in FIG. 8 have a basket or trough shape with overflow edges 85 and 86, respectively, directed towards each other. Pouring devices 83 and 84 are positioned on either side of centre line 6*a* just above the bottom of the mold, and are adapted to hold a charge of molten metal. The length of devices 83 and 84 is substantially equal to, usually somewhat shorter than, the length of sidewall portions 4*a* and 4*b*. If desired, pouring devices 83 and 84 are provided with a lining (not shown) that has thermal insulating properties.

Pouring devices 83 and 84 are suspended at both side plates 87 from cross bars 81 and 82 by suspending bars 88 that are pivotably attached at one end to the cross bars 81 and 82 at 89, and are fixedly attached at the other end to the side plates 87 of devices 83 and 84 at attachment points 90. A vertically spaced bolt 91 is attached to each suspending bar 88 above attachment point 90. A slot 92 is provided in the side plates 87 above attachment points 90 so that bolts 91 can be slidably moved in slots 92. Bolts 91 can be suitably locked, such as, for example, with a nut (not shown), in a desired position onto side plates 87, providing second fixed attachment points for the suspending bars 88. By changing the position of bolts 91 in slots 92, the tilt of the pouring devices 83 and 84 can be adjusted to control the amount of molten metal in the devices.

To move pouring devices 83 and 84 into a pouring position the devices are movably attached to one end of moving rods 94 by means of toggles 93, located at all side plates 87 and fixed to the attachment points 90. The upper ends of each of the pairs of moving rods 94 at each side of the pouring devices are pivotably connected to the ends 95 of pistons 96 of hydraulic cylinders 97. Cylinders 97 are mounted on cross bars 81 and 82 vertically above the centre line 6*a* of mold 1. Alternatively, one cylinder 97 with a piston 96, the latter suitably connected at 95 to rods 94, may be used.

In this embodiment the mold is moved under the pouring devices in a stationary position by moving means (not shown), and is moved away from under the pouring devices for the removal of the casting from the mold.

For any of the embodiments, means (not shown) are provided to fill the pouring device(s) with molten metal, and means (not shown) may be provided to skim any dross from the metal in the pouring device prior to casting.

Figure 2:
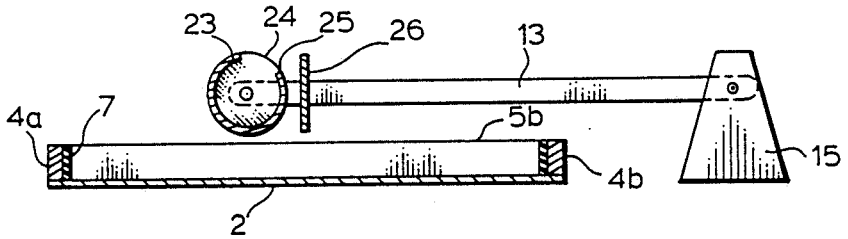
FIG. 2 is a section through line A—A of FIG. 1.

In the method of casting metals in the plate mold according to FIGS. 1 and 2, pouring device 10 is either positioned in a predetermined position over the stationary mold 1 by the positioning means, e.g. by pivoting support arms 12 and 13 on fulcrums 14 and 15, or mold 1 is positioned under pouring device 10 into a stationary position, such that dissipating plate 26 is substantially above one of the centre lines 6. Device 10 is rotated on axes 11, if necessary, such that opening 24 is in the upper half of the rotation path described when device 10 is rotated. An amount of molten metal is added through opening 24 into the stationary pouring device 10, the amount being predetermined and substantially sufficient to pour a casting of the desired weight and thickness. Any dross on the metal may be skimmed off. Pouring device 10 with the charge of molten metal is now rotated by turning axes 11 such that molten metal overflows substantially over the full length of the overflow edge 25 against pouring energy dissipating plate 26 and then substantially vertically downward onto bottom 2 of mold 1. Upon hitting the bottom, the melt separates into two elongated streams of substantially equal volume that flow away from the centre line in opposite directions towards and substantially parallel to the side wall portions parallel to that centre line of the mold. The streams are balanced so that wave action is obviated and a casting of even thickness is obtained, as described. The molten metal spreads out evenly over the entire bottom, fills the mold to a height substantially equal to the desired thickness of the casting and begins to solidify. Essentially no wave action occurs and the casting has a substantially even thickness.

After the pouring is completed, i.e. the amount of melt has been substantially discharged from the pouring device 10, the molten metal is allowed to solidify.

Solidification is accelerated by applying cooling. Cooling may be applied to the bottom 2 of the mold by directing sprays of water against the bottom. Cooling is continuous, intermittent or programmed and may be started either before, during or after the pouring of melt from the pouring device. If desired, the amount of cooling and the start and end of cooling may be controlled, for example, by measuring the temperature of the bottom of the mold and controlling the amount of water supplied to the spray nozzles (not shown) in response to the value of the measured temperature. If desired, cooling may also be directed to the top surface of the casting, usually when the surface of the casting has solidified. Whether bottom or top cooling or both is applied depends on the metal being cast, the thickness of the casting and the desired crystallization of the casting. After pouring is completed the pouring device is removed from above the mold by activating the positioning means, e.g., by pivoting support arms 12 and 13, or, alternatively, the mold is removed from under the pouring device. The casting is subsequently removed from the mold. In case of the lining of the mold being shaped to provide rounded edges on the casting, the casting may be lifted from the mold or, alternatively, the sidewall of the mold may be wholly or in part removed from around the casting before the casting is removed.

The operation of the casting according to the second embodiment (FIGS. 6 and 7) is carried out in a similar way. Pouring devices 30 and 40 are positioned above stationary mold 1 by the positioning means, e.g., by pivoting support arms 32, 33 and 42, 43 on fulcrums 34, 35 and 44, 45, respectively, openings 54 and 54*a* being in an upward position such that predetermined substantially equal amounts of molten metal can be charged into the pouring devices. Alternatively, the mold may be moved under stationary pouring devices 30 and 40. Once positioned in stationary position and charged, the pouring devices are simultaneously rotated such that melt overflows from the devices in two elongated flows of substantially equal volume over overflow edges 55 and 55*a* onto bottom 2 of mold 1. When contacting the bottom of the mould, each of the flows splits into two streams flowing in opposite directions. The two streams flowing towards each other are of substantially equal volume and flow in opposite directions and substantially parallel to the centre line and meet at centre line 6*a*. Any wave action is eliminated because waves in the two streams dampen and cancel each other out upon meeting at the centre line. The melt in the mold is allowed to solidify. Cooling may be applied in a manner similar to that described with reference to FIGS. 1 and 2.

In the operation of the embodiment of FIG. 8, the mold is moved in a stationary position under the pouring devices 83 and 84. If desired, the tilt of the pouring devices 83 and 84 is adjusted by adjusting the position of bolts 91 in slots 92. The pouring devices 83 and 84, which are in a substantially horizontal position (pistons 96 retracted), are filled with substantially equal charges of a predetermined amount of molten metal. The pistons 96 are then extended by activating cylinders 97 whereby the pouring devices move away from each other over arcuate paths by means of the moving rods 94 and the suspending bars 88. Substantially simultaneously, molten metal starts to discharge into two elongated flows of substantially equal volume, from the pouring devices into the mold over the overflow edges 85 and 86 as soon as the devices reach the tilt position at which melt reaches the overflow edges. Discharging occurs in opposite directions substantially parallel to centre line 6*a* over the full length of the overflow edges and continues until the predetermined amount of the charge has been poured, which is when the pouring devices have completed the arcuate paths ending in proximity of each of the longitudinal sidewall portions. The cylinders are subsequently re-activated to retract the pistons whereby the pouring devices return to their position in proximity to the longitudinal centre line. As with the pouring according to the embodiment of FIGS. 6 and 7, two of the streams of melt on the bottom of the mold are of substantially equal volume and meet at centre line 6 and any waves are dampened and cancelled out. The melt in the mold is allowed to solidify. Cooling may be applied in a manner similar to that described with reference to FIGS. 1 and 2.

In each of the operations according to the various embodiments, once the casting has solidified to a degree sufficient to be removed from the mold, the pouring device(s) is (are) moved away from above the mold, or, alternatively, the mold is moved away from under the pouring device(s). If necessary, in the case of using a shaped lining over at least a portion of the length of sidewall 3 of the mold to provide rounded edges of the casting where desired, sidewall 3, or one or more sections thereof, is removed from around the casting. The casting is removed from the mold by suitable removal means (not shown) such as, for example, a device having one or more vacuum suction cups. The removal means contacts the solidified casting and removes the casting from the mold. Once the casting has been removed, the sidewall is repositioned on the bottom if required, the mold is returned to under the pouring device(s) or, alternatively, the pouring device(s) is (are) moved in the desired position(s) over the mold, molten metal is added to the pouring device(s) and the next casting is made.

Because of the system and method of casting, the pouring can be done in a very short time without excessive turbulence or wave action. Using the method and apparatus according to the invention 6 to 30 mm thick plate castings with a substantially even thickness can be poured in from 3 to 10 seconds, and solidified castings can be removed from 1 to 3 minutes after the pouring is completed. Thus a casting cycle is only about 1 to 3 minutes giving a high rate of production and yielding castings without a flash and of an even thickness.

The invention will now be illustrated by means of the following non-limitative examples.

EXAMPLE 1

A plate mold as illustrated in FIGS. 1 and 2 was used to cast plates of a lead-silver-calcium-aluminum alloy. The mold had a 10 mm thick steel bottom and measured 965 by 1575 mm. The mold was substantially rectangular in shape with rounded inside corners and had a depth of 50 mm. A 5 mm thick layer of a shaped silicon rubber lining was attached to the inside of the vertical sidewall of the mold. The lining was shaped to provide a casting with rounded edges. The rounding had a radius of 7 mm. The height of the rounded shaped lower portion of the lining above the mold bottom was 13 mm. A rotatable, cylindrical pouring device with a diameter of 203 mm and an opening with an overflow edge with a length of 1550 mm was suspended between parallel support arms rotatable on fulcrums. A steel pouring energy dissipating plate 165 by 1524 by 1.5 mm thick was attached vertically between the support arms at a distance of 19 mm from the overflow edge of the pouring device. The plate was positioned 100 mm on one side of the longitudinal centre line of the mold (The plate being between the centre line and the pouring device). The bottom of the mold was continuously and uniformly cooled by means of water sprays. The pouring device was charged with 180 kg of molten lead alloy at 400° C. containing 0.25% silver, 0.07% calcium and 0.02% aluminum. The pouring device was rotated and discharged over a period of 7 seconds, the discharging starting at a distance of 100 mm above the mold bottom. The charge flowed evenly across the bottom of the mold and no wave action was observed. The molten metal solidified evenly and rapidly. The pouring device was swung away, and after 60 seconds the casting was lifted from the mold with suction cups. No removal of the mold sidewall was required. The casting had an even thickness of 9.5 mm and had substantially no flash.

EXAMPLE 2

Figure 3:
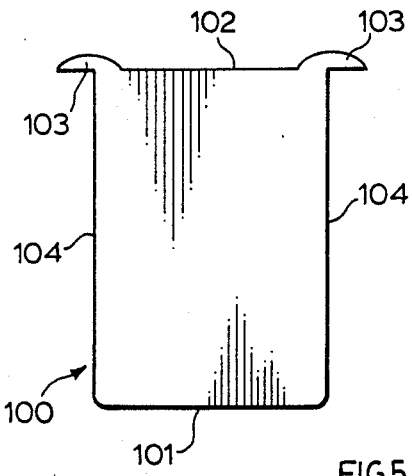
FIG. 3 is a plan view of an electrode used in electro refining.
Figure 4:
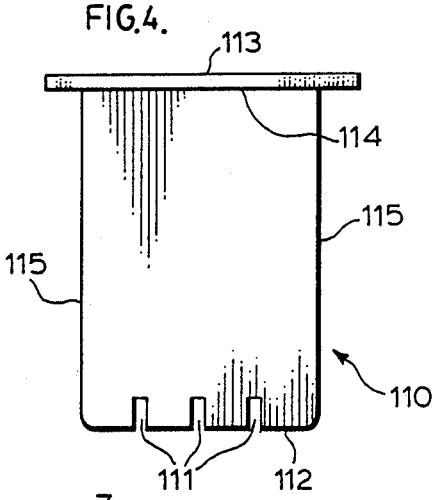
FIG. 4 is a plan view of an electrode used in electrowinning.

A plate mold having extensions for lifting lugs on one side was used to cast lead bullion anodes used in the electrorefining of lead. The mold had a 10 mm thick bottom and measured 700 by 900 by 40 mm deep. The mold was substantially rectangular in shape with extensions in one of the transverse sidewalls to provide spaces for integral lifting lugs as shown in FIG. 3. The corners of the mold at the other one of the transverse sidewalls were rounded. A 4 mm thick, layer of silicon rubber lining was attached to the inside and over the full length and height of the sidewall, including the spaces for the lugs.

The mold was moved by moving means in a stationary position under a pair of opposingly directed basket-shaped pouring devices supported from a framework, as shown in FIG. 8. The identical pouring devices 83, 84 were 800 mm long, 350 mm wide and 100 mm deep and were suspended from the framework such that the overflow 85, 86 edges were, at the start of pouring, 80 mm above the bottom of the mold and 50 mm to the left and right, respectively, of the longitudinal centre line of the mold. The pouring devices were lined with a 6 mm thick layer of aluminum oxide-silica-based insulating material (Pyroteck$_{TM}$ M12, compressible board). The length of each of the suspending bars 88 and the moving rods 94 was 400 mm. The bottom of the mold was continuously and uniformly cooled by means of water sprays.

The pouring devices were simultaneously charged with equal amounts of 160 kg of molten lead bullion at 410° C. The cylinders 97 were activated and the extending pistons 96 in cooperation with suspending bars 88 and moving rods 94 caused pouring devices 83 and 84 to move away from each other and started the pouring of bullion into the mold. The bullion flowed into the mold, and any wave action was dampened effectively. The pouring was completed in 3 seconds at which time the pouring devices had reached the end of the arcuate path at 200 mm from the inside edge of the sidewall. The bullion solidified evenly and rapidly. After the pouring was completed the pouring devices were brought back into their original positions at the longitudinal centre line by retracting pistons 96, and the mold was moved away from under the pouring devices. The casting was readily removed from the mold with suction cups applied to the top of the casting. No removal of the mold sidewall was necessary. The casting had an even thickness of 28 mm and had substantially no flash. The time for completing one casting cycles was 60 second.

It is understood that variations and modifications may be made in the embodiments of the present invention without departing from the scope of the appended claims. Although the detailed description and examples are made with specific reference to the casting of electrodes, the invention is also useful for the manufacture of castings other than electrodes.

We claim:

1. A method for producing a casting in a substantially horizontal substantially rectangular plate mold, said mold having a flat substantially horizontal bottom, a substantially vertical side wall attached to said bottom, said substantially vertical sidewall comprising a pair of parallel longitudinal sidewall portions and a pair of parallel transverse sidewall portions, the length of said longitudinal sidewall portions being at least equal to the length of said transverse sidewall portions, said mold having centre lines comprising a longitudinal centre line parallel to said longitudinal sidewall portions and a transverse centre line parallel to said transverse sidewall portions; said mold having a layer of a flexible insulating material having a molded shape along at least a portion of its length attached to said substantially vertical sidewall along its full length and height, said molded shape having an upper vertical face portion and a lower rounded face portion having a curvature sufficient to provide rounded edges on said casting and having a height extending above the bottom of the mold that is greater than the thickness of said casting, said method comprising the steps of pouring an amount of molten metal into said mold from at least one pouring device to form two elongated streams from each device on the bottom of the mold, said streams being of substantially equal volume substantially parallel to one of said centre lines in opposite directions, said amount of molten metal being sufficient to form a casting of predetermined thickness in said mold; dissipating the pouring energy of the molten metal while said amount of molten metal is being poured; solidifying said molten metal to form said casting; and removing said casting from said mold, said casting having a substantially even thickness throughout.

2. A method as claimed in claim 1, wherein the molten metal is poured from one pouring device into the mold in proximity to and substantially along the length of one of the centre lines and said pouring energy is dissipated prior to forming said two streams on the bottom of the mold by means of a pouring energy dissipating plate, said plate being operatively connected to said pouring device, and said plate being vertical, parallel to and in proximity to said pouring device and in proximity to said centre line.

3. A method as claimed in claim 1, wherein said molten metal is poured substantially simultaneously from two pouring devices in two elongated flows of substantially equal volume, said devices being opposedly positioned substantially parallel to and substantially along the full length of each of the sidewalls of one of the pairs of the pair of longitudinal sidewall portions and the pair of transverse sidewall portions, each said flows split into two streams of substantially equal volume flowing in opposite directions, the two streams flowing towards each other in a direction towards the centre line of the corresponding sidewall portions meeting at said centre line when any waves are dampened and cancelled out.

4. A method as claimed in claim 3, wherein the pouring of the amount of molten metal being poured simultaneously from said pouring devices is started in proximity of said centre line and is completed in proximity of each sidewall portion of the corresponding pair of parallel sidewall portions.

5. A method as claimed in claim 3, wherein the pouring of the amount of molten metal being poured simultaneously from said pouring devices is carried out in proximity to each sidewall portion of one of the pairs of said pair of longitudinal sidewall portions and said pair of transverse sidewall portions.

6. Apparatus for the casting of metal plates which comprises a substantially rectangular plate mold having a flat substantially horizontal bottom, a substantially vertical side wall attached to said bottom, said substantially vertical sidewall comprising a pair of parallel longitudinal sidewall portions and a pair of parallel transverse sidewall portions, the length of said longitudinal sidewall portions being at least equal to the length of said transverse sidewall portions, said mold having centre lines comprising a longitudinal centre line parallel to said longitudinal sidewall portions and a transverse centre line parallel to said transverse sidewall portions; said mold having a layer of a flexible insulating material having a molded shape along at least a portion of its length attached to said substantially vertical sidewall along its full length and height, said molded shape having an upper vertical face portion and a lower rounded face portion having a curvature sufficient to provide rounded edges on said casting and having a height extending above the bottom of the mold that is greater than the thickness of said casting, at least one rotatable elongated pouring device positioned above the bottom of said mold, said pouring device being adapted to hold a charge of molten metal, said pouring device having an overflow edge, said overflow edge being substantially parallel to one of the longitudinal centre line and the transverse centre line and having a length that is substantially equal to the length of one of the longitudinal centre line between said longitudinal sidewall portions and the transverse centre line between said transverse sidewall portions; means to rotate said at least one pouring device such that said charge flows from each said device into said mold over the full length of said overflow edge; and means for dissipating the pouring energy from the flowing of said charge into said mold such that said charge flows in said mold in two elongated streams from each of said pouring devices, said streams being of substantially equal volume parallel to one of said centre lines in opposite directions to each other to provide a casting having a substantially even thickness.

7. Apparatus as claimed in claim 6, wherein one rotatable elongated pouring device is positioned above the bottom of said mold and said means for dissipating the pouring energy comprises a pouring energy dissipating plate operatively connected vertically in proximity and parallel to said device and in proximity to one of said centre liens during pouring of said charge into the mold.

8. Apparatus as claimed in claim 6, wherein two rotatable elongated pouring devices are positioned above the bottom of said mold each in proximity to one pair of said pair of longitudinal sidewall portions and said pair of transverse sidewall portions and in opposing directions such that the overflow edges are in a direction parallel to and towards one of said centre lines.

9. Apparatus as claimed in claim 8, wherein means are provided to move said pouring devices during discharging of molten metal therefrom from the proximity of one of said centre lines to the proximity of each of the sidewalls of one pair of the pair of longitudinal sidewall portions and the pair of transverse sidewall portions.

10. Apparatus as claimed in claim 9, wherein said means to move the pouring devices are operatively connected to at least one piston of a hydraulic cylinder and are adapted to move over arcuate paths, the curve of said arcuate paths being such that said pouring devices discharge said charge of molten metal when said cylinder is activated.

* * * * *